US005181657A

United States Patent [19]

Davis

[11] Patent Number: 5,181,657

[45] Date of Patent: Jan. 26, 1993

[54] COMPOSITE RUBBER/CONCRETE RAILROAD GRADE CROSSING SYSTEM

[75] Inventor: R. Andrew Davis, Lake Oswego, Oreg.

[73] Assignee: Omni Rubber Products, Inc., Portland, Oreg.

[21] Appl. No.: 698,137

[22] Filed: May 10, 1991

[51] Int. Cl.[5] ..... E01C 9/04

[52] U.S. Cl. ..... 238/8; 404/34; 238/7

[58] Field of Search ..... 238/2, 5, 6, 7, 8, 9, 238/382; 404/34, 39

[56] References Cited

U.S. PATENT DOCUMENTS

| | | | |
|---|---|---|---|
| 3,773,255 | 11/1973 | Schoulties et al. | 238/2 |
| 4,236,670 | 12/1980 | Limmergard et al. | 238/8 |
| 4,365,743 | 12/1982 | Trickel et al. | 238/382 X |
| 4,372,488 | 2/1983 | Schonthaler et al. | 238/8 |
| 4,449,666 | 5/1984 | Hales et al. | 238/8 X |
| 4,461,421 | 7/1984 | Maass | 238/8 |
| 4,606,498 | 8/1986 | Grant et al. | 238/8 |
| 4,860,952 | 8/1989 | Schmidt | 238/8 |
| 4,899,933 | 2/1990 | Martin | 238/8 |

FOREIGN PATENT DOCUMENTS

| | | | |
|---|---|---|---|
| 533009 | 11/1954 | Belgium | 238/8 |
| 1908832 | 1/1971 | Fed. Rep. of Germany | 238/8 |
| 1946712 | 3/1971 | Fed. Rep. of Germany | 238/8 |
| 205939 | 1/1984 | Fed. Rep. of Germany | 238/8 |
| WO86/06428 | 11/1986 | World Int. Prop. O. | 238/8 |

*Primary Examiner*—Michael S. Huppert
*Assistant Examiner*—Robert S. Katz
*Attorney, Agent, or Firm*—Chernoff, Vilhauer

[57] ABSTRACT

A grade crossing system for extending a roadway across a railroad track comprises elongate elastomeric pad units which abut each side of the rails in the track but do not extend across the entire crossing. The elastomeric pad units rest on the ties that carry the rails and have planar top surfaces that are coplanar with the tops of the rails. The remainder of the crossing is filled with non-elastomeric panels that also rest on the ties and have planar top surfaces that are coplanar with the top surface of the rails. The abutting edges of the pad units and the panels overlap such that the panels hold the pad units down against the ties and urge them against the sidewalls of the rail flanges. Thus, mechanical fasteners are not required to hold the crossing elements in place.

3 Claims, 2 Drawing Sheets

COMPOSITE RUBBER/CONCRETE RAILROAD GRADE CROSSING SYSTEM

BACKGROUND AND SUMMARY OF THE INVENTION

This invention relates to a railroad grade crossing using a composite of elastomeric and non-elastomeric elements, and in particular, to such a crossing which does not require mechanical fasteners.

Many highways and arterials which cross railroad tracks utilize elastomeric crossing elements, such as those disclosed in Trickel et al. U.S. Pat. No. 4,365,743. Crossings, using elastomeric elements not only are inherently smoother than crossings made from non-elastomeric materials, but maintain their smoothness much longer. Timber crossings, for example, wear quite quickly and soon present a rough crossing surface. While asphalt wears better than timber, it is difficult to compact asphalt immediately adjacent to the rails. Thus, an asphalt grade crossing soon settles adjacent to the rails which also creates a rough surface. In addition, it is difficult to prevent water from entering between the asphalt and the rails and when freezing occurs the water expands and causes deterioration of the asphalt. Concrete wears better than asphalt and does not require mechanical compaction, however, freezing is a problem with this material also. In addition, concrete grade crossings usually have metal edges which occasionally causes shorting to occur between the rails which can activate the crossing signs. Not only do elastomeric grade crossing elements provide greater smoothness, they are easier to remove than timber, concrete or asphalt which permits them to be reused when the track is brought up to grade by adding ballast and retamping.

However, grade crossings which utilize elastomeric components are quite expensive and, accordingly, it is not economically feasible to use this type of crossing for roads which are infrequently traveled. In these situations, composite crossing systems having an elastomeric element adjacent to the rails and non-elastomeric elements over the remainder of the crossing have been utilized. A composite system of this type provides many of the advantages of an elastomeric crossing at a much lower cost than a full elastomeric system. In addition, a composite system is even easier and less expensive to install and to remove than a full elastomeric system and thus facilitates repairs to the track and rail bed. One such system composite is disclosed in Hales et al. U.S. Pat. No. 4,449,666.

Rather than pouring the elastomeric portion in place between the rails and the non-elastomeric portion as is done in Hales et al., it would be simpler and less expensive to use precast elastomeric pads, similar to the pads disclosed in Trickle et al., along with precast concrete panels, similar to those that are used as crossing elements in their own right. The precast concrete panels are heavy and thus do not have to be mechanically fastened to the ties. However, the elastomeric pads are too light to rely on their own weight to keep them in place and mechanical fasteners must be used. This not only increases the installation cost but the partial pads that would be used in a composite system would be quite narrow and leave little room for fasteners.

The subject invention overcomes the foregoing shortcomings and limitations of the prior art by providing a composite crossing system with elastomeric pad units adjacent to the sides of the rails, and non-elastomeric panels over the remainder of the crossing. An interfitting joint between each elastomeric pad unit and non-elastomeric panel causes the panel to hold the pad on the ties. This joint includes an overlapping portion that angles upwardly from the ties extending towards the rail. In a preferred embodiment, the non-elastomeric panels have metal edge protectors cast in them to prevent crumbling due to the impact of vehicular traffic. In addition, the non-elastomeric panels include integral attachment devices to facilitate their being lifted into place.

The weight of the non-elastomeric panels holds the crossing elements down on the ties, and, since the crossing elements substantially fill the space between the roadway and the rails and between the rails, the elements will not move perpendicular to the rails. In a preferred embodiment, end restraints, that are attached to the ties, prevent the elements from moving parallel with the rails.

Accordingly, it is a principal object of the present invention to provide a railroad grade crossing system having elastomeric elements adjacent to both sides of the rails and non-elastomeric elements over the remainder of the crossing.

It is a further object of the subject invention to provide such a system in which the non-elastomeric elements hold the elastomeric elements down against the ties.

It is a still further object of the subject invention to provide such a system in which the nonelastomeric elements urge the elastomeric elements against the rail flanges.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
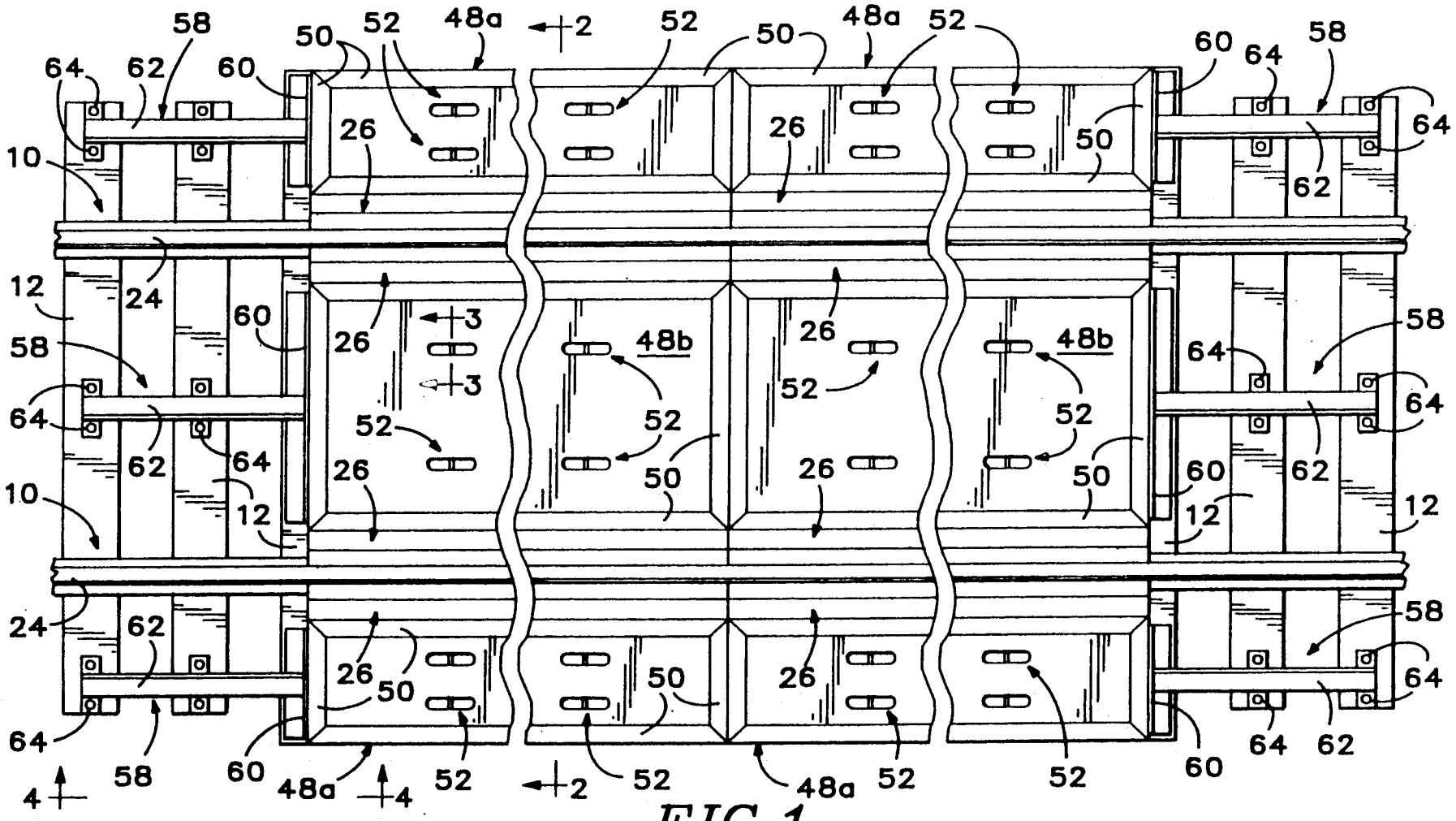
FIG. 1 is a foreshortened plan view of a railroad grade crossing embodying the subject invention.
Figure 2:
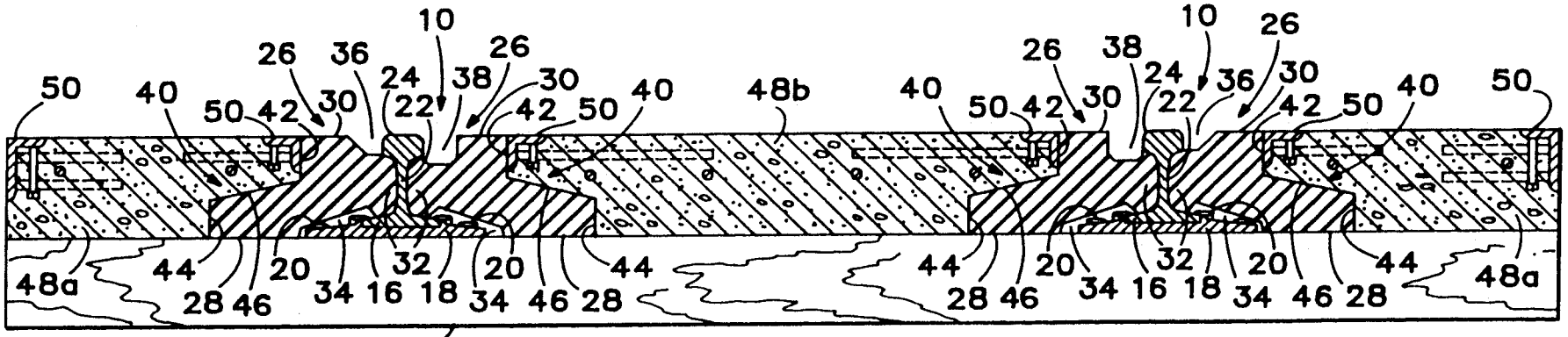
FIG. 2 is a sectional view taken on the line 2—2 of FIG. 1.

Referring to FIGS. 1 and 2 of the drawings, a composite railroad grade crossing system is utilized in connection with a railroad track comprising a pair of parallel, side-by-side rails 10 that are attached to a plurality of transverse, spaced-apart ties 12. Each rail has a horizontal base 16, which in the drawings is shown as being attached to the ties through tie plates 18 and spikes 20. The subject crossing system works equally well with other types of rail attachment systems. Extending upwardly from the base is a thin web 22 having vertical sidewalls 23. An enlarged ball 24 which carries the rail car wheels (not shown) is located on top of the web.

The grade crossing comprises elastomeric pad units 26 which are located on each side of each rail. Each pad unit has a planar bottom surface 28 that rests on the ties and a planar top surface 30 that is coplanar with the top of the rail ball 24 and supports the wheels of vehicular traffic passing over the grade crossing. One end 32 of the pad unit is arranged to abut the side wall 23 of the rail web. A cavity 34 defined in the bottom of the pad unit fits over the tie plates 18 and spikes 20. The approach pad units, which are located on the outside of the rails, have rail grinding relief 36, adjacent to the rail ball that accommodates grinding the ball, and the center pad units have flange way relief 38 adjacent to the rail ball that accommodates the flanges of the rail car wheels. The edge 40 of each pad unit that faces away from the rail is in the shape of a stair-step, with a vertical face at the top 42 and bottom 44, and an intermediate face 46 that angles upwardly from the ties as it extends towards the rail 10. The pad units 26 can be made from comminuted rubber, as described in Trickel et al. '743, from virgin rubber, or from other elastomeric materials having sufficient strength and rigidity to provide a roadway surface.

Located between the two center pad units and between each approach pad unit and the roadway are non-elastomeric panels. In the preferred embodiment, the panels are cast concrete. There are two approach panels 48*a*, one located between each approach pad unit and the existing roadway. The outer end of each approach panel 48 is vertical, and the inner end conformingly overlaps with the abutting end of the respective pad unit 26. There is one center panel 48*b* and each of its ends conformingly overlaps the abutting end of one of the center pads units.

Figure 3:
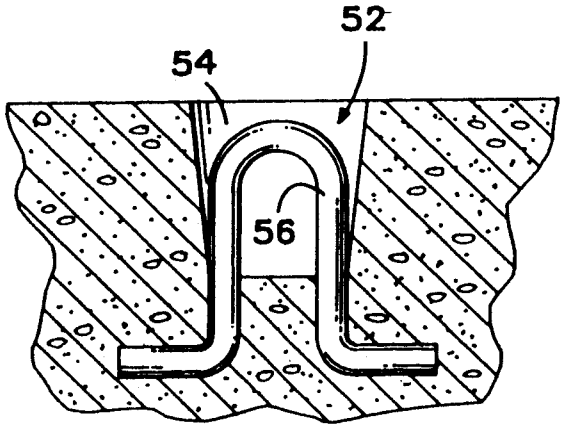
FIG. 3 is a fragmentary sectional view, at an enlarged scale, taken along the line 3—3 of FIG. 1.

The edges of the panels 48*a* and *b* have steel edge protectors 50 cast in them. The edge protectors are held in place by being attached to the reinforcing bar located in the panels and form a wear resistant edge. The edge protectors prevent the crumbling that would otherwise occur as a result of the repeated traffic loads on the concrete edges. Also located at selected locations in the panels 48*a* and *b* are attachment devices 52 for lifting the panels. Referring now also to FIG. 3, each attachment device includes a cavity 54 formed in the top surface of the panel and a lifting hook 56 that is partially imbedded into the concrete and projects into the cavity.

Due to the weight of the large non-elastomeric panels 48*a* and *b*, and the overlapping edges between the panels and the pad units 26, the entire grade crossing is held in place on the ties 12 without the need for fasteners. Also, because of the sloped intermediate faces 46 of the pad units, the ends 32 of the pad units are urged into contact with the sidewalls 23 of the rails 10. Thus, water is channeled away from the rail and will not seep below the crossing where it could cause degradation of the roadbed that supports the ties.

Figure 4:
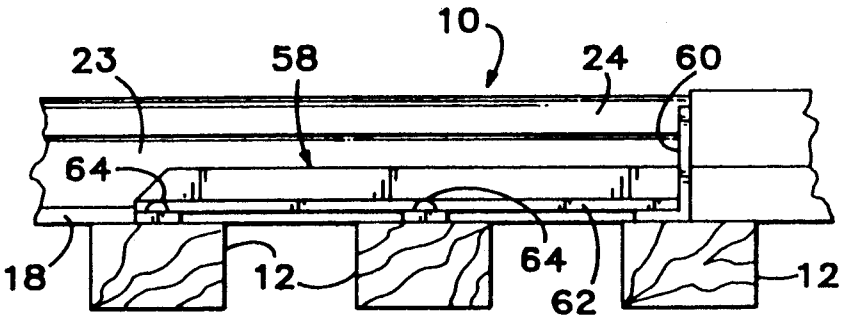
FIG. 4 is a fragmentary sectional view taken along the line 4—4 of FIG. 1.

The pad units and panels are sized to completely fill the spaces between the rails and between the rails and the roadway. Thus, movement of the grade crossing is substantially eliminated in a direction perpendicular to the rails. Movement of the grade crossing in a direction parallel with the rails is prevented by panel restraints 58. Referring now also to FIG. 4, each panel restraint 58 comprises a vertical pad 60 with a horizontally extending leg 62 attached to it. One of the panel restraints is placed at each end of each panel 48*a, b* and is attached to a tie 13 by means of spikes 64. The panel restraints extend over a portion of the pad units also, and thus prevent movement of the entire crossing in a direction parallel with the rails.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A grade crossing system for extending a paved roadway across a railroad track formed by a pair of parallel rails having top surfaces which are coplanar with the surface of the roadway and supported on a plurality of laterally displaced spaced-apart ties, said system comprising:

(a) elastomeric pad unit located on each side of each rail, each said pad unit having a bottom surface that contacts and rests on the ties, a planar top surface that is coplanar with the top surfaces of the rails and a first edge that abuts one of the rails;

(b) non-elastomeric panels that fit between said pad units and between said pad units and the roadway, said panels having bottom surfaces that contact and rest on the ties and planar top surfaces that are coplanar with the top surfaces of the rails; and (c) said pad units and panels having abutting edges in which a linear portion of said panels overlaps a linear portion of said pad units with at least part of said overlapping portions defining a plane that angles upwardly from the ties extending toward the rail that is adjacent thereto.

2. The grade crossing system of claim 1 wherein said non-elastomeric panels include metallic edge protectors at the intersection between said panels and said pad units.

3. The grade crossing system of claim 2 wherein said non-elastomeric panels include metallic edge protectors at the edge of said panels that abut the roadway.

* * * * *

UNITED STATES PATENT AND TRADEMARK OFFICE

CERTIFICATE OF CORRECTION

PATENT NO. : 5,181,657

DATED : January 26, 1993

INVENTOR(S) : R. Andrew Davis

It is certified that error appears in the above-identified patent and that said Letters Patent is hereby corrected as shown below:

Col. 1, Line 55: delete "Trickle" insert -- Trickel --

Col. 2, Line 31: delete "nonelastomeric" insert -- non-elastomeric --

Col. 3, Line 30: delete "pads" insert -- pad --

Col. 4, Line 30: delete "unit" insert -- units --

Signed and Sealed this

Twenty-third Day of November, 1993

*Attest:*

Bruce Lehman

BRUCE LEHMAN

*Attesting Officer*

*Commissioner of Patents and Trademarks*